US005522949A

United States Patent [19]

Widmer et al.

[11] Patent Number: 5,522,949

[45] Date of Patent: Jun. 4, 1996

[54] CLASS OF DUCTILE IRON, AND PROCESS OF FORMING SAME

[75] Inventors: Robert Widmer, Wenham; Daniel H. Zick, Andover; Jane L. LaGoy, Pepperell, all of Mass.

[73] Assignee: Industrial Materials Technology, Inc., Andover, Mass.

[21] Appl. No.: 315,925

[22] Filed: Sep. 30, 1994

[51] Int. Cl.[6] ..... C21D 5/00; C22C 37/00

[52] U.S. Cl. ..... 148/321; 148/633; 148/615; 148/545; 148/548

[58] Field of Search ..... 148/545, 633, 148/548, 615, 321, 320

[56] References Cited

U.S. PATENT DOCUMENTS

| | | | |
|---|---|---|---|
| 4,596,606 | 6/1986 | Kovacs et al. | 148/545 |
| 4,880,477 | 11/1989 | Hayes et al. | 148/545 |
| 5,248,354 | 9/1993 | Tada et al. | 148/545 |

OTHER PUBLICATIONS

Kovacs, *Modern Casting,* Mar. 1990, pp. 38–41.

J. F. Wallace, *Review of Problem Solving Research Projects on Gray and Ductile Irons,* American Foundrymen's Society, Inc., 97th Casting and Congress and Castexpo '93 Apr. 24–27, 1993, Reprint No. 93–223.

K. L. Hayrynen, et al., *More About the Tensile and Fatigue Properties of Relatively Pure ADA,* American Foundrymen's Society, Inc., 97th Casting and Congress and Castexpo '93 Apr. 24–27, 1993, Reprint No. 93–127.

*Primary Examiner*—Deborah Yee

*Attorney, Agent, or Firm*—William C. Geary, III; Lahive & Cockfield

[57] ABSTRACT

A new class of ductile iron is formed by the hot isostatic pressing of a ductile iron casting, followed by austempering of the ductile iron casting. Hot isostatic pressing can be carried out at a pressure in the range of 10,000 to 17,000 psi at a temperature above 1600° F., and usually in the range of 1850° F. to 2050° F. Austempering of the material is carried out by heating to the austenitizing temperature (about 1500° F. to 1800° F.), maintaining the austenitizing temperature for a suitable time period, and rapidly cooling to an austempering temperature (about 400° F. to 750° F.) to form ausferrite within the sample.

11 Claims, 6 Drawing Sheets

CLASS OF DUCTILE IRON, AND PROCESS OF FORMING SAME

BACKGROUND OF THE INVENTION

The present invention relates to a new class of ductile irons, and to the process of forming such ductile irons.

Gray irons have carbon in the form of finely dispersed graphite flakes. These flakes allow the propagation of microscopic cracks when the alloy is placed under stress. Although gray irons are easily cast, they are weak in tensile strength.

In ductile irons, the carbon is in the form of small spheroids instead of flakes. These small spheroids act as "crack arresters" and stop the propagation of microscopic cracks when the iron is under stress. They allow ductile irons to have greater tensile strength than other irons, as well as other desirable properties. Several types of ductile irons may be produced, either "as-cast" or by means of special heat treatments.

Austempered ductile iron (ADI) is a known grade of material. ADI represents a special family of ductile iron alloys which possess almost twice the tensile strength of ordinary ductile irons, along with desirable characteristics of good elongation, toughness, good wear resistance and fatigue strength. These properties are achieved through special heat treatment called "austempering". For a general survey of ADI, see "Austempered Ductile Iron: Fact and Fiction", Kovacs, *Modern Casting* (March 1990), p.38–41.

The microstructure of austempered ductile iron is a matrix of acicular ferrite and high-carbon stable austenite. Austempered ductile iron castings are less brittle than common ductile iron, have improved strength-to-weight ratio, better surface detail and finish, improved machinability and reduced machining allowance.

The chemical composition of the base iron in ADI is similar to that of conventional ductile iron: about 3.6 C, 2.5 Si, 0.3 Mn, 0.015 maximum S and 0.06 maximum P. Alloying elements such as Cu, Ni, and Mo are added to the base composition. These elements are added not to increase strength or hardness, but to enhance heat treatability. The addition of the alloying elements does not affect the castability of the iron and does not increase the presence of casting defects. Large castings cool slower during quenching .and require more alloying than small castings.

All other casting process variables such as molding, nodularization, inoculation and pouring temperature are the same for ADI as they are for ductile iron. Alloying elements are often added to the ladle and the rest of the casting process is unaltered on a ductile iron line.

A typical ADI heat treatment cycle is shown in FIG. 1, where, according to Kovacs, the casting first is heat treated (A-B) to a temperature range of 1550°–1750° F. and held (B-C) at temperature for one to three hours. During this holding period, the casting becomes fully austenitic and the matrix becomes saturated with carbon.

After the casting is fully austenitized, it is quenched (C-D) in a quenching medium at a temperature range of 460–750 F. and held (D-E) at temperature for one-half to four hours. This temperature is called the "austempering" temperature. The austempering temperature and the holding time determine the final microstructure and properties of the ADI casting.

The effect of the austempering temperature on yield and tensile strength can be dramatic. High austempering temperatures result in high ductility, high fatigue and impact strengths and relatively low yield and tensile strengths. At low austempering temperatures, ADI displays high yield and tensile strengths, high wear resistance and lower ductility and impact strength. Strength increases rapidly by lowering the austempering temperature.

A high quenching rate during heat treatment is important so as to avoid formation of pearlite during quenching. The part must reach the targeted austempering temperature rapidly. Cooling profiles are also important, significantly affect material strength. After isothermal austempering, the casting is cooled to room temperature.

The five ASTM standard grades for ADI (ASTM 897-890) are as shown in Tables 1A and 1B. By comparison, a moderate grade wrought and tempered steel typically has tensile strength of about 192,000 psi, yield strength of about 162,000 psi, elongation of about 14.5% and hardness of about 385 BHN. However, parts made from wrought steel are heavier and more expensive to make and finish than are parts made from ADI.

TABLE 1A

THE FIVE ASTM STANDARD ADI GRADES (ASTM 897-90)

| GRADE | TENSILE STRENGTH | YIELD STRENGTH | ELONGATION (%) | IMPACT ENERGY* (FT-LBS) | TYPICAL HARDNESS (BHN) |
|---|---|---|---|---|---|
| 1 | 125 | 80 | 10 | 75 | 269–321 |
| 2 | 150 | 100 | 7 | 60 | 302–363 |
| 3 | 175 | 125 | 4 | 45 | 341–444 |
| 4 | 200 | 155 | 1 | 25 | 388–477 |
| 5 | 230 | 185 | N/A | N/A | 444–555 |

*Minimum values

**Un-notched Charpy bars tested at 72° F. ± 7° F.

TABLE 1B

THE FIVE ASTM STANDARD ADI GRADES (ASTM 897M-90)

| GRADE | TENSILE STRENGTH (MPa) | YIELD STRENGTH (MPa) | ELONGATION (%) | IMPACT ENERGY* (Joules) | TYPICAL HARDNESS (BHN) |
|---|---|---|---|---|---|
| 1 | 850 | 550 | 10 | 100 | 269–321 |
| 2 | 1050 | 700 | 7 | 80 | 302–363 |
| 3 | 1200 | 850 | 4 | 60 | 341–444 |
| 4 | 1400 | 1100 | 1 | 35 | 388–477 |
| 5 | 1600 | 1300 | N/A | N/A | 444–555 |

*Minimum Values
*Un-Notched Charpy Bars Tested At 22° C. ± 4° F.

Austempered ductile iron is used in many punishing applications. For example, it has been used in railroads for car wheels, suspension parts, track plates, latches, and other pans. ADI is also used in making heavy truck parts, including spring hangers, u-bolt plates, hubs, jack stand gears, mounting brackets, engine parts, and many other parts. Despite the useful properties offered by ADI, this material lacks the greater combined tensile strength and ductility of the more expensive wrought and tempered steels.

It is therefore an object of the present invention to provide a class of austempered ductile iron having a higher combination of tensile strength and ductility than previously known, and which may be substituted for moderate grade tempered wrought steels. It is also an object of the invention to provide a class of austempered ductile iron that consistently achieves desired properties, including tensile strength and ductility. A further object of the invention is to provide a process for forming such a material. Other objects will be apparent upon review of the following.

SUMMARY OF THE INVENTION

According to the present invention a new class of a ductile iron is provided which has substantially improved tensile strength and ductility, approaching that of a moderate grade wrought, quenched, and tempered steel.

This new class of ductile iron materials is formed according to a process by which typical ductile iron parts are cast to near net sizes with desired shapes of varying complexity. The resulting parts are then processed by hot isostatic pressing (HIP) in a gaseous (inert argon or helium) atmosphere contained within a heated pressure vessel. During this process the part is subjected to high pressure levels at temperatures that can exceed 1600° C. Following the HIP step, the part is subjected to austempering. It has been found that the combination of the HIP process with subsequent austempering has a significant and desirable effect on the mechanical properties of ductile iron, resulting in this new class of ductile irons.

It is believed that the property improvements achieved by this invention can be attributed, in part, to the HIP closure of shrinkage porosity present in the ductile iron in the as-cast condition as well as to microstructural effects. Austempering results in a very substantial increase in ductility as well as improved ultimate tensile and yield strengths. For all of these properties the scatterband is markedly decreased in the practice of the invention, thus resulting in materials that more consistently achieve desirable properties.

Preferably, the process of this invention is applied to ductile iron castings, such as sand castings, investment castings, and other cast irons, where the presence of surface-connected shrinkage porosity does not prevent the healing of porous defects.

This process enables the formation of wrought steel-like ductile iron, resulting in a class of ADI characterized as having a combination of high strength and ductility, while also exhibiting a very narrow scatterband in these properties. In one embodiment of the invention this process yields wrought steel-like ductile iron samples having tensile strength in excess of about 190,000 psi, yield strength in excess of about 150,000 psi, and about 9% total elongation.

This new ductile iron composition is formed by the steps of casting a ductile iron sample, HIP processing the sample at a temperature in excess of 1600° F., and austempering the sample. In one practice of the invention, the HIP processing includes heating the sample in the range of about 1800° F. to 2050° F. for about 4 hours, followed by cooling to room temperature, for example to about 75° F. The HIP processing is typically conducted at about 10,000 to 17,000 psi.

BRIEF DESCRIPTION OF THE DRAWINGS

These and other features and advantages of the present invention will be more fully understood by reference to the following detailed description in conjunction with the attached drawings in which like reference numerals refer to like elements and in which.

DESCRIPTION OF THE INVENTION

Figure 1:
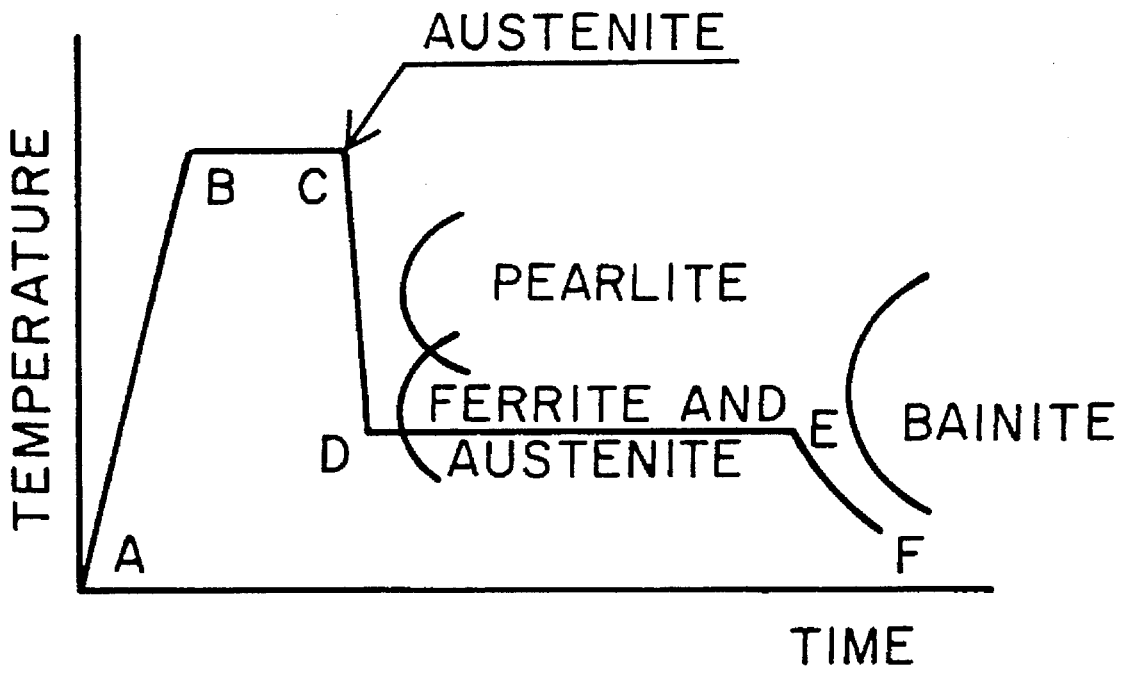
FIG. 1 (PRIOR ART)
FIG. 1 illustrates the phases of a conventional, prior art ADI heat treatment cycle.
Figure 2:
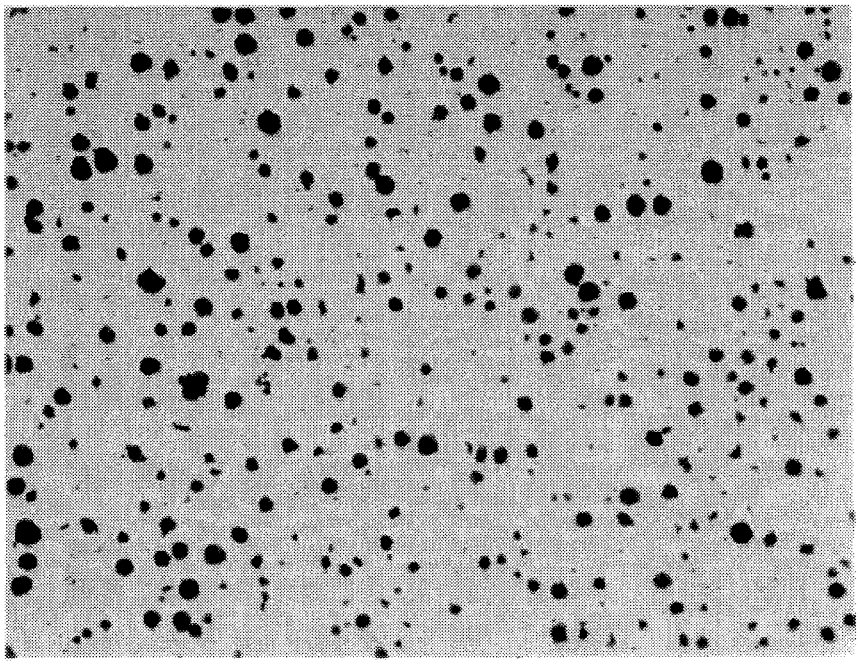
FIG. 2 illustrates the as-cast microstructure for polished representative ductile iron sand castings at 50× magnification.

As noted above, the invention provides a new class of ductile iron which has physical properties approaching those of wrought steel. This class of material possesses high strength and ductility, greater than that of conventional ductile iron, while exhibiting a narrow scatterband. These materials are characterized by tensile strength of greater than about 190,000 psi, yield strength greater than about 150,000 psi and about 9% total elongation.

This new class of ductile iron materials can be formed by first casting a ductile iron part. Following casting the part is subjected to hot isostatic pressing, and the HIP processed part is then austempered.

Hot isostatic pressing typically is carried out in a gaseous atmosphere (e.g., argon or helium) at a temperature in the range of about 1600° F. to 2050° F. at a pressure of about 10,000 17,000 psi. Preferably, HIP is conducted at temperatures in the range of 1850°–2050° F. The duration of the hot isostatic pressing depends upon the size of the part. Typically, HIP is conducted for about 2 to 5 hours, and most preferably for about 4 hours.

The austempering processing step generally follows austempering procedures known in the art. During this processing step the sample is heated to an austenitizing temperature in the range of about 1500°–1800° F. A preferred temperature is in the range of about 1550° F.–1700° F. The part is held at this temperature for a time period sufficient to bring the entire part to temperature and to saturate the austenite with carbon. Following heating the part is rapidly cooled to an austempering (or transformation) temperature in the range of about 400°–750° F. Preferably, the sample is cooled at a rate of about 100° F. per minute. The part is held a this temperature for an amount of time sufficient to generate the ausferrite structure. This quenching step can be effected by techniques known to those having ordinary skill in the art. In a currently preferred embodiment quenching is conducted in a salt bath.

In a preferred austempering process the samples are first preheated at a temperature of about 1100° F. for about 90 minutes. The part is then heated to and maintained at an austenitizing temperature of about 1685° F. for about 100 minutes. Thereafter, the part is rapidly quenched to an austempering temperature of about 620° F. in a salt bath and maintained at this temperature for about 135 minutes. The part is then air cooled to room temperature.

EXAMPLE

The present invention was discovered and verified during the program set forth below in which ductile iron sand cast materials were hot isostatically pressed at three different temperatures between 1850° F. and 2050° F. and subsequently austempered. Samples of the non-HIP processed as-cast materials were also austempered as controls.

The castings included two sand cast cylinders with an outer diameter (OD) of 6.3 inches and a thickness of 0.7 inch. The castings had the composition as set forth in Table 2.

TABLE 2

| Composition of Ductile Iron Sand Castings | |
|---|---|
| Element | Wt. % |
| Total C | 3.54 |
| Si | 2.68 |
| Cu | 0.18 |
| Mg | 0.058 |
| Mn | 0.16 |

TABLE 2-continued

| Composition of Ductile Iron Sand Castings | |
|---|---|
| Element | Wt. % |
| Cr | 0.028 |
| S | 0.011 |
| Ni | 0.001 |
| Mo | 0.001 |

The samples were HIP processed at 1850° F., 1950° F., and 2050° F. The HIP cycles were carried out at 15,000 psi with a four hour hold at temperature and pressure. Subsequent studies showed that porosity closure was accomplished at temperatures as low as about 1650° F.

Four castings were selected for the study. Sections of these castings were taken for each of the three HIP temperature runs and for one set of non-HIP processed, as-cast samples. All 16 sections were austempered as follows: preheat for 90 minutes at 1100° F., austenitization for 100 minutes at 1685° F., salt bath quench to 620° F., and hold for 135 minutes at temperature followed by air cool.

Figure 3:
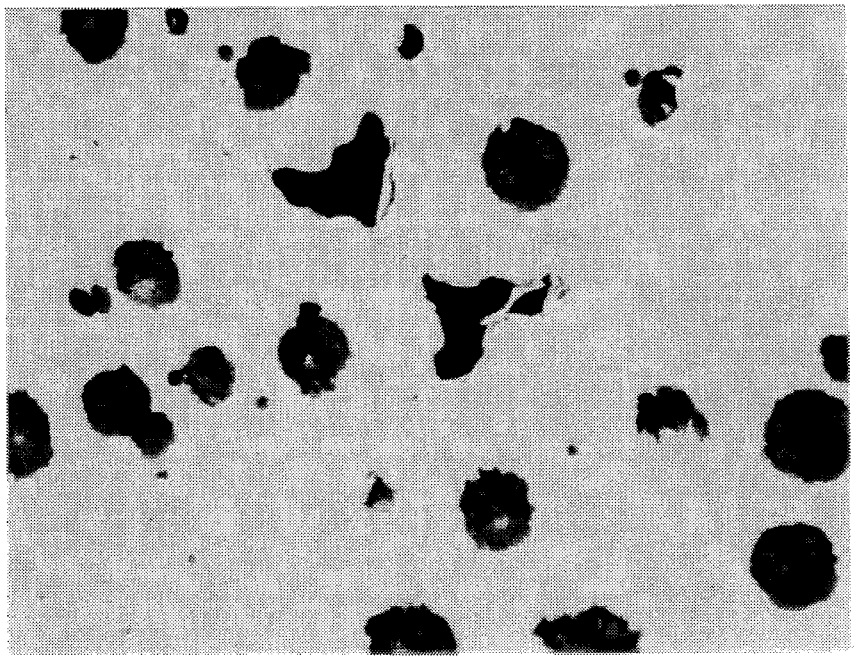
FIG. 3 illustrates the shrink pores in a representative as-cast ductile iron sand casting.

Longitudinal sections were taken, following austempering, from the center of each casting half for metallography. In addition, five tensile bars were machined in accordance with ASTM A897-90 from each of the casting sections and tested at room temperature. The as-cast micro structure of a representative casting is illustrated in FIG. 3.

All materials were characterized by radiography, macro and micro examination and room temperature tensile testing. The results obtained demonstrate clearly that HIP processing has a significant positive effect on the structure and mechanical properties of sand-cast austempered ductile iron. In the sand castings, shrinkage porosity was eliminated or reduced, which resulted in a significant increase in ductility. Best results were observed after processing at the highest HIP temperature (2050° F.). The mechanical analysis of the ADI sand castings is shown in Table 3.

TABLE 3

| Mechanical Testing Results on ADI Sand Castings | | | |
|---|---|---|---|
| Sample No. | Tensile Strength (K psi) | Yield Strength @ 0.2% Offset (K psi) | % Elongation (4 × D) |
| As-Cast + Austemper: | | | |
| S5E-1** | 144 | 144 | 0.5 |
| S5E-2 | 175 | 150 | 3.0 |
| S5E-3 | 134 | 132 | 2.0 |
| S5E-4* | 146 | 146 | 1.4 |
| S5E-5* | 169 | 155 | 0.5 |
| average | 153.6 (17.5) | 145.4 (8.6) | 1.5 (1.1) |
| 1850° F. HIP + Austemper: | | | |
| S4F-1 | 194 | 155 | 5.0 |
| S4F-2 | 196 | 157 | 8.0 |
| S4F-3 | 195 | 153 | 1 0 |
| S4F-4 | 193 | 156 | 5.0 |
| S4F-5 | 195 | 158 | 6.5 |
| average | 194.6 (1.1) | 155.8 (1.9) | 6.9 (2.1) |
| 1950° F. HIP + Austemper: | | | |
| S5A-1* | 157 | 152 | 2.0 |
| S5A-2 | 191 | 145 | 7 |

TABLE 3-continued

Mechanical Testing Results on ADI Sand Castings

| Sample No. | Tensile Strength (K psi) | Yield Strength @ 0.2% Offset (K psi) | % Elongation (4 × D) |
|---|---|---|---|
| S5A-3 | 192 | 150 | 7 |
| S5A-4 | 193 | 146 | 7 |
| S5A-5 | 195 | 151 | 8.5 |
| average | 185.6 (16.1) | 148.8 (3.1) | 6.3 (2.5) |
| 2050° F. HIP + Austemper: | | | |
| S4B-1 | 195 | 155 | 8.5 |
| S4B-2 | 192 | 152 | 8.0 |
| S4B-3 | 193 | 152 | 9.5 |
| S4B-4 | 193 | 153 | 10 |
| S4B-5 | 194 | 151 | 10 |
| average | 193.4 (1.1) | 152.6 (1.5) | 9.2 (0.9) |

*Fracture at radius. Porosity at fracture
**Porosity at fracture
( )Denotes one standard deviation It was noted that only marginal improvements were observed in some castings during this study. This can be attributed to the presence of surface-connected porosity within the casting. Also, finish-machined ductile iron castings are unsuitable for treatment according to the present invention because the machining process exposes porosity to the surface. The pores become filled with gas during the HIP cycle and thus the voids are not able to collapse and heal.

Most of the cast pieces that were evaluated showed shrink porosity in various degrees. Many of these indications cannot be found on the x-ray films taken after the HIP treatment. Since at least some of the porosity disappeared, it is believed that the remaining voids are connected with the surface and therefore cannot be healed by HIP. However, porosity which is too small to be detected by radiography also exists in the material. It is believed that some of these small flaws are healed by HIP and therefore impose a positive effect on mechanical properties.

Figure 4:
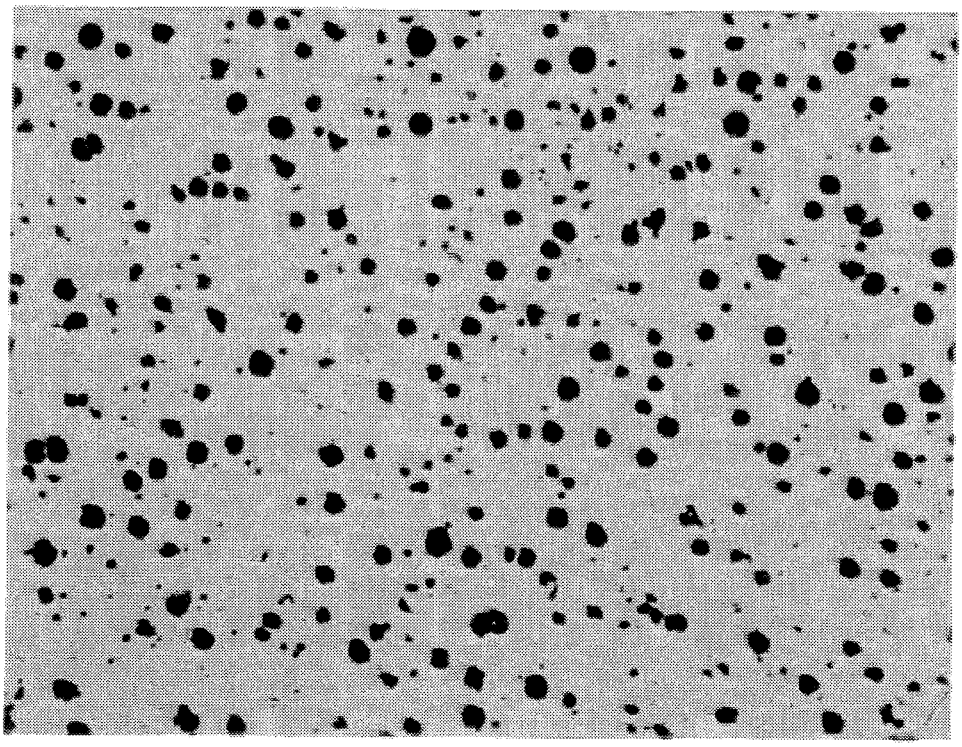
FIG. 4 illustrates nodule size in a ductile sand casting after 2050° F. HIP plus austemper.

Microscopic examination of selected sections showed various degrees of shrink porosity in all of the as-cast specimens (see FIG. 3). However, no porosity was found in the post-HIP sand cast materials. FIG. 3 illustrates the shrink pore in an as-cast sand casting at a magnification of 200×. FIG. 4 illustrates, at a magnification of 50×, the sand casting after processing according to the present invention by HIP treatment at 2050° F. followed by austempering.

Figure 5A:
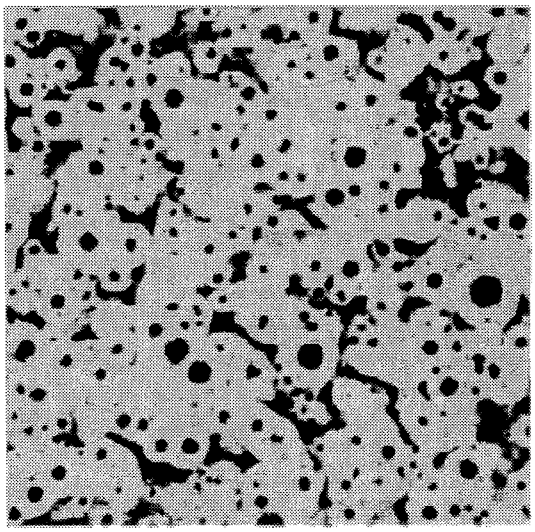
FIGS. 5A–5D illustrate a ductile iron sand casting microstructure, in the as-cast condition and HIP processed condition at 2050° F., before and after austempering.
Figure 5C:
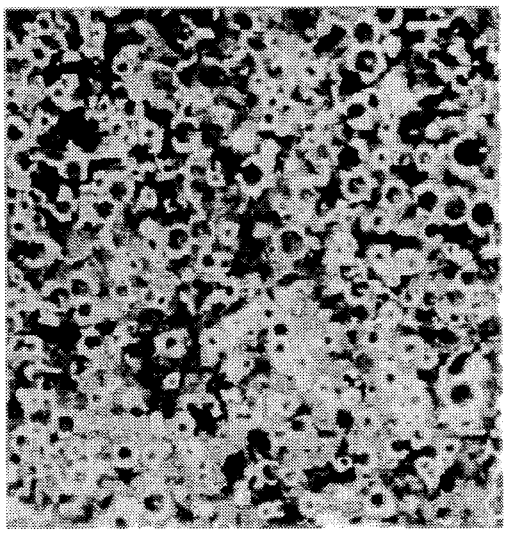
Figure 5B:
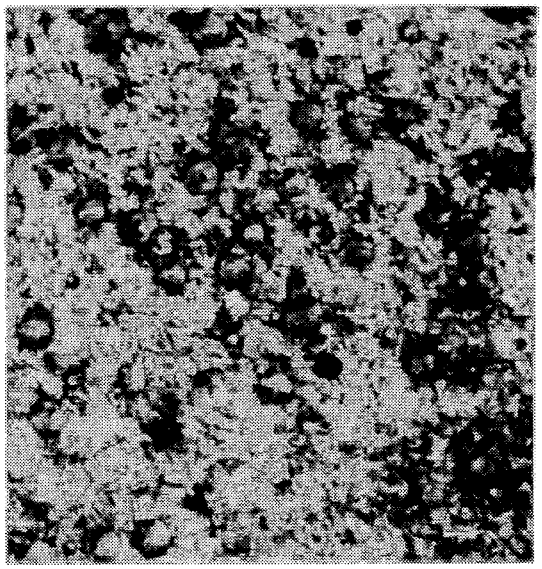
Figure 5D:
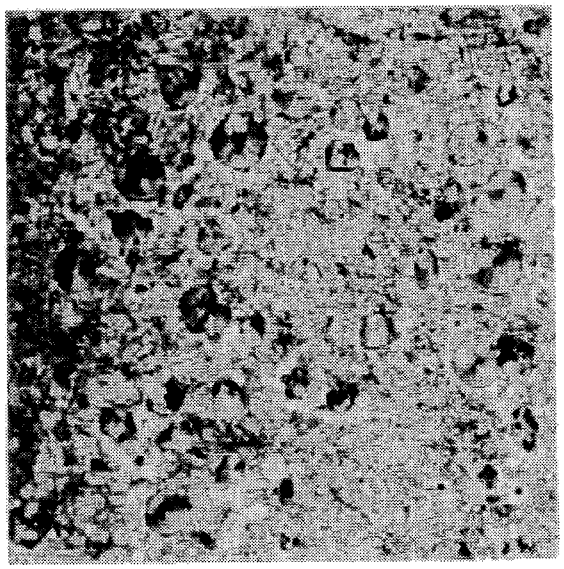

An examination of the details of the microstructures was done at higher magnification on acid-etched specimens. The acid solution attacked and sometimes dislodged the graphite nodules, but the microstructural elements of the matrix are still able to be recognized. These results are evident in FIGS. 5A–5D which depict the microstructures of the sand castings in the as-cast condition (FIG. 5A), cast plus austemper (FIG. 5B), HIP processed only at 2050° F. (FIG. 5C), and HIP plus austemper at 2050° F. (FIG. 5D) conditions. In FIGS. 5A and 5C (no austempering) ferrite is indicated by light areas and pearlite is indicated by dark areas. FIGS. 5B and 5D illustrate the formation of ausferrite after austempering.

Figure 6:
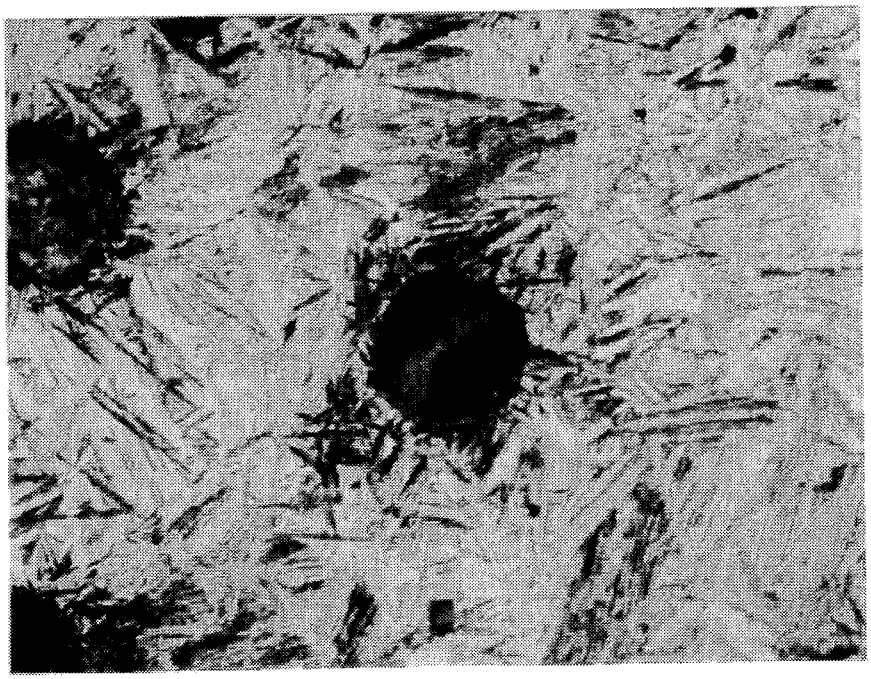
FIG. 6 is a photomicrograph of the as-cast and austempered sand casting microstructure.
Figure 7:
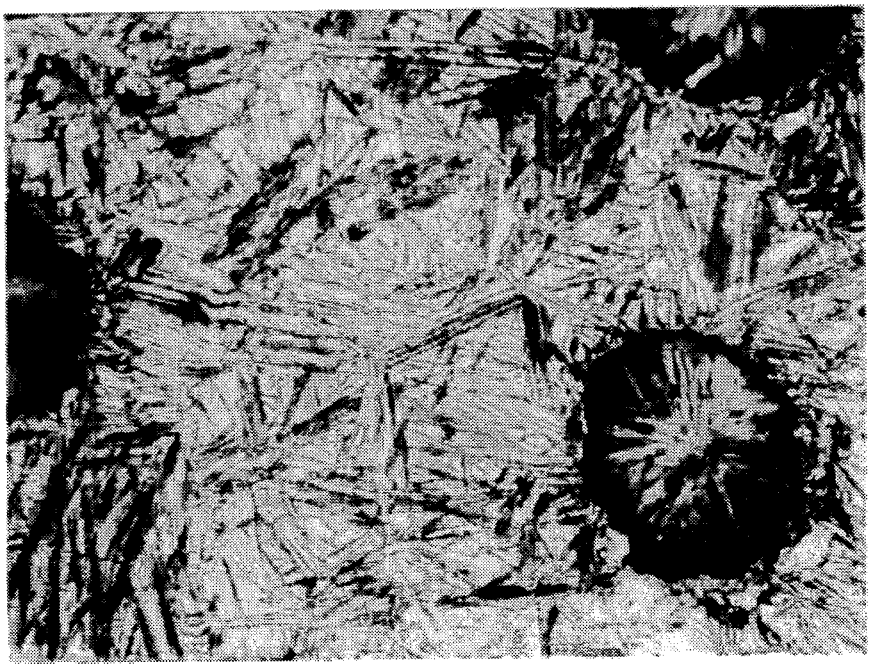
FIG. 7 is a photomicrograph of the sand casting after 1850° F. HIP plus austemper.
Figure 8:
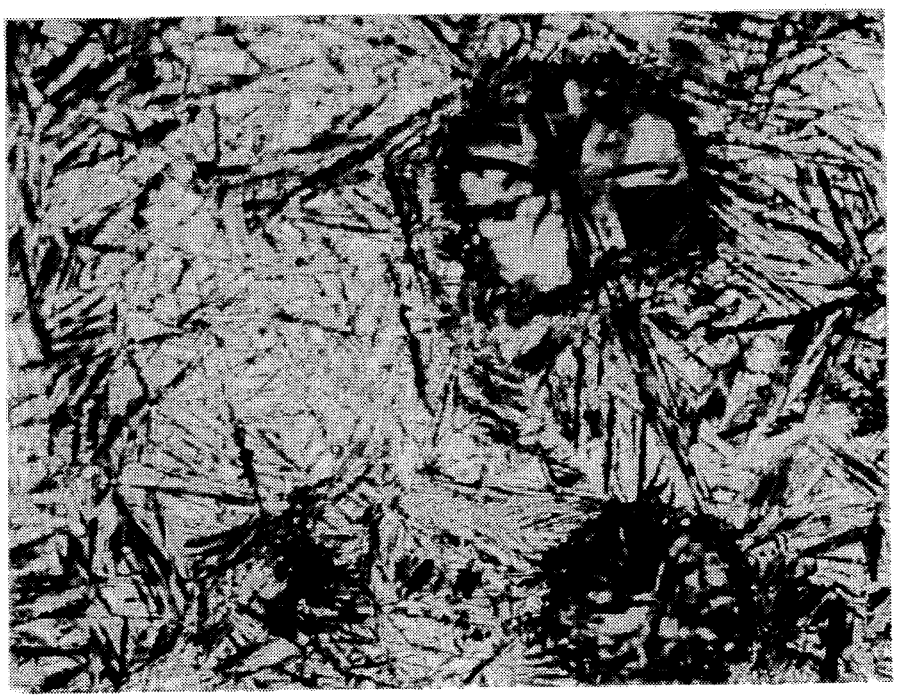
FIG. 8 is a photomicrograph of the sand casting after 1950° F. HIP plus austemper.
Figure 9:
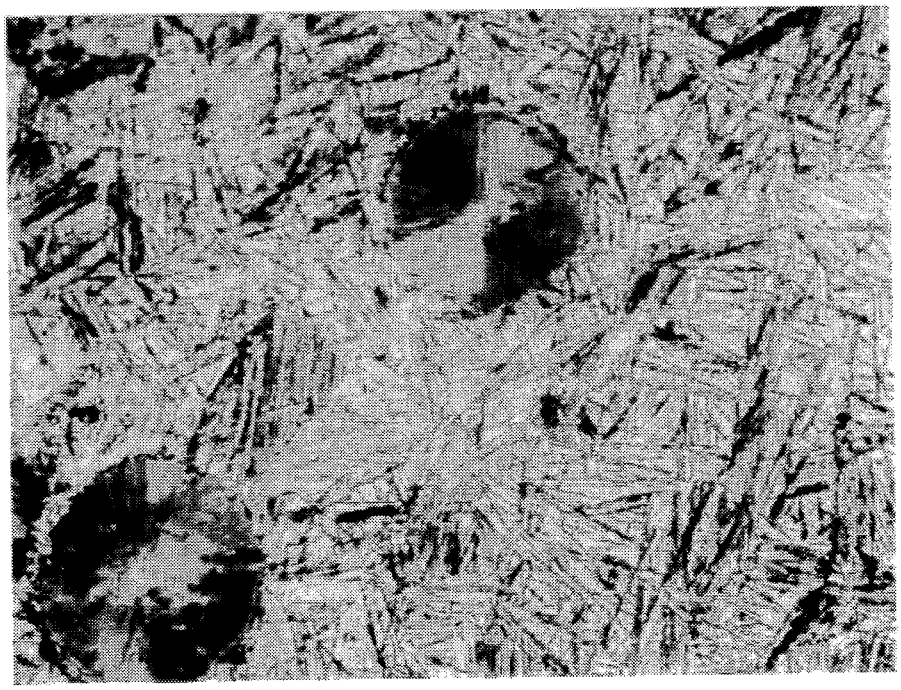
FIG. 9 is a photomicrograph showing the sand casting after 2050° F. HIP plus austemper.

FIGS. 6–9 illustrate the microstructures of the samples, in the as-cast and post-HIP states, after austempering. FIG. 6 illustrates the microstructure (at 500× magnification) of a sand cast sample, etched with as 2% nital solution after austempering. FIG. 7 illustrates the microstructure (at 500× magnification) of a sand cast sample after HIP processing at 1850° F. followed by austempering. FIG. 8 illustrates the microstructure (at 500× magnification) of a sand cast sample, etched with a 2% nital after HIP processing at 1950° F. followed by austempering. FIG. 9 illustrates the microstructure (at 500× magnification) of a sand cast sample etched with a 2% nital solution after HIP processing at 2050° F. followed by austempering. It is evident from these photomicrographs that the HIP treatment did not significantly affect the graphite nodule size and distribution.

The results of all room temperature tensile tests are listed in Table 3. These data illustrate that the samples show rather low strength and ductility values in the as-cast plus austempered condition. However, after HIP processing and austempering, the samples show a very dramatic improvement in ductility, along with an improvement in tensile strength and yield strength.

The highest ductility values were achieved at the highest HIP processing temperature (2050° F.). Under the same conditions, the scatter in data is minimal as compared to that of the as-cast values. These samples demonstrated ultimate tensile strength, yield strength, and total elongation properties that are remarkable for a ductile iron since these properties are within the range of a heat-treated medium alloy wrought steel, such as 4130. Table 4 compares the mechanical properties of the class of ductile iron prepared according to the present invention, austempered ductile iron, current ASTM specifications for various grades of ductile iron, and wrought high strength steel.

TABLE 4

Mechanical Properties of Austempered Ductile Iron (ADI) vs. Wrought High Strength Steel

| Material | Tensile Strength (K psi) | Yield Strength (K psi) | % Elongation |
|---|---|---|---|
| ASTM Grade 1 ADI | 125 | 80 | 10 |
| ASTM Grade 2 ADI | 150 | 100 | 7 |
| ASTM Grade 3 ADI | 175 | 125 | 4 |
| ASTM Grade 4 ADI | 200 | 155 | 1 |
| As Cast + Austempered ADI | 153.6 (17.5)* | 145.4 (8.6)* | 1.5 (1.1)* |
| HIP + Austempered ADI | 193.4 (1.1)* | 152.6 (1.5)* | 9.2 (0.9)* |
| Wrought 4130 Steel quenched & tempered | 192 | 162 | 14.5 |

*Data represent averages of 5 test results, with one standard deviation shown in parenthesis.

It is clear from the results of these experiments that the process of this invention, that utilizes processing and austempering of ductile iron, shows a very beneficial effect on the mechanical properties of the sample. The improvements in properties are believed to result from the closure of shrinkage porosity present in the as-cast samples. This results in a very substantial increase in ductility as well as ultimate tensile and yield strengths. For all of these properties, the scatter in results is also markedly decreased compared to previously known austempered ductile iron castings.

Use of austempered ductile iron may be desirable from a weight and cost standpoint. However, as can be seen from data provided herein, tensile strength and ductility vary substantially from grade to grade, yielding substantial design trade-offs. However, the present invention provides HIP processed and austempered ductile iron having substantially improved strength and ductility. The material prepared according to this invention is a cast ductile iron having wrought steel-like properties.

The entirety of all references cited herein is expressly incorporated by reference.

It will be understood that the above description pertains to only several embodiments of the present invention. That is, the description is provided by way of illustration and not by way of limitation. Various modifications may be made to the invention without departing from the intended scope thereof.

What is claimed is:

1. A process of forming wrought ductile iron, comprising the steps of casting a ductile iron sample;

HIP processing the sample at a temperature in excess of 1650° F. and at a pressure in the range of about 10,000–17,000 psi; and austempering the sample.

2. The process of claim 1 wherein the ductile iron sample is formed by a sand casting.

3. The process of claim 1 wherein the HIP processing includes the step of heating the sample to between about 1850° F. to 2050° F. for about 4 hours, at a pressure in the range of about 10,000 psi–17,000 psi, followed by cooling to a temperature between about room temperature and 100° F.

4. The process of claim 1 wherein the austempering step is conducted by:

preheating the sample to about 1100° F.;

heating the sample to an austenitizing temperature in the range of about 1500° to 1800° F. for sufficient time to saturate austenite within the sample with carbon; and rapidly cooling the sample to an austempering temperature in the range of about 400° to 750° F. and holding at the austempering temperature for an amount of time sufficient to generate ausferrite within the sample.

5. The process of claim 4 wherein the step of rapidly cooling the sample is conducted at a rate of about 100° F. per minute.

6. The process of claim 4 wherein the step of rapidly cooling the sample is conducted in a salt bath.

7. The process of claim 4 wherein the sample is held at the austempering temperature for about two hours.

8. A product prepared of the process of claim 1, characterized by HIP closure of shrinkage porosity present in the as-cast sample.

9. The product of claim 8, further characterized as having a substantial increase in ductility as well as improved ultimate tensile and yield strengths over the as-cast sample.

10. A ductile iron material characterized as having mechanical properties of tensile strength of at least about 190,000 psi, yield strength of at least about 150,000 psi and about 9% total elongation.

11. The material of claim 10 further characterized as having a narrow scatterband in detected properties of ductility, ultimate tensile strength and yield strength.

* * * * *